United States Patent [19]

Henke

[11] 3,969,162

[45] July 13, 1976

[54] METHOD OF PRODUCING SILICON STEEL STRIP

[76] Inventor: Robert H. Henke, 4 Foxwood Drive, Pittsburgh, Pa. 15238

[22] Filed: Aug. 1, 1974

[21] Appl. No.: 493,531

Related U.S. Application Data

[62] Division of Ser. No. 239,538, March 30, 1972, Pat. No. 3,843,422.

[52] U.S. Cl. ..... 148/111; 148/31.55; 148/112

[51] Int. Cl.[2] ..... H01F 1/04

[58] Field of Search ..... 148/111, 112, 31.55

[56] References Cited

UNITED STATES PATENTS

| | | | |
|---|---|---|---|
| 2,084,336 | 6/1937 | Goss | 148/111 |
| 2,084,337 | 6/1937 | Goss | 148/111 |
| 3,144,363 | 8/1964 | Aspden et al. | 148/111 |
| 3,413,165 | 11/1968 | Buchi et al. | 148/111 |
| 3,764,406 | 10/1973 | Littmann | 148/112 |
| 3,843,422 | 10/1974 | Henke | 148/111 |
| 3,874,954 | 4/1975 | Wildschutz | 148/111 |

*Primary Examiner*—Walter R. Satterfield
*Attorney, Agent, or Firm*—Buell, Blenko & Ziesenheim

[57] ABSTRACT

A method of producing silicon steel strip from slabs is provided which includes the steps of reducing the slabs in a planetary mill to a thickness of 0.060 to 0.10 inch at a temperature above that at which MnS will precipitate, cooling to between 300°F to 1500°F and reducing the strip at that temperature to a thickness of 0.020 to 0.030.

3 Claims, 2 Drawing Figures

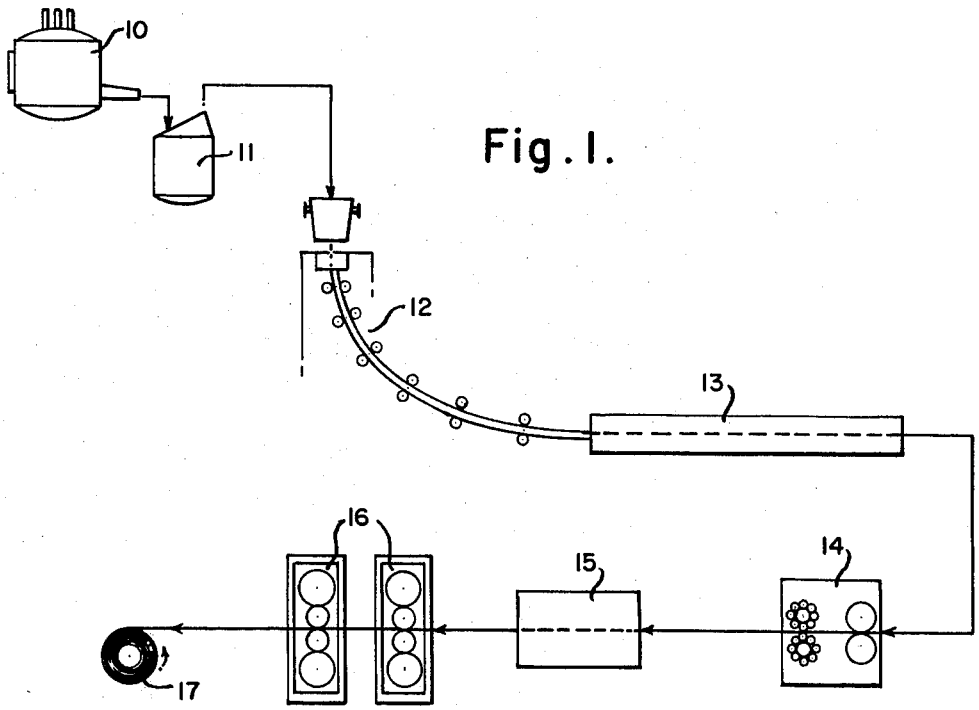
Fig. 1.
Fig. 2.
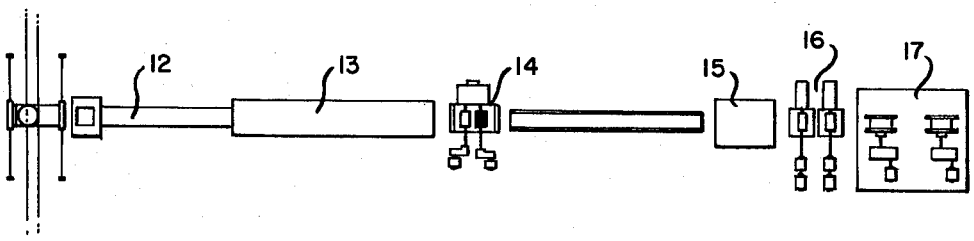

METHOD OF PRODUCING SILICON STEEL STRIP

This application is a division of co-pending application Ser. No. 239,538, filed Mar. 30, 1972, now U.S. Pat. No. 3,843,422.

This invention relates to methods of producing silicon steel strip and particularly to a method of producing silicon steel strip having a high degree of preferred orientation and highly directional magnetic properties.

It is well known that the hot strip mill process is one of the important factors necessary to control in order to obtain a high degree of orientation of the crystallographic structure in the [100] (110) direction or "cube on edge" crystal orientation in the rolling direction. There have been many attempts made to improve the processing of such strip on conventional hot strip mills. These attempts have been directed primarily to those hot mills which use a reversing roughing mill with unidirectional finishing stands and those which use unidirectional roughing and finishing stands. Typical of the work which has been done in the past on this area are the methods disclosed in Littmann U.S. Pat. No. 2,599,340 and Crede at al. U.S. Pat. No. 2,867,557. It is clear from these patents that control of processing time and temperatures has been the most serious problem facing this particular segment of the steel making art.

The processing times and temperatures for a typical oriented silicon steel mill process are:

| Process Equipment | Elapse Time | Approx. Thickness | Average Temperature |
|---|---|---|---|
| Deliver from furnace or Blooming Mill Shear | 0 | 8.250 | 2400/2450 F. |
| Transfer time to Rougher | 30 sec. | | |
| Reversing Rougher, Pass No. 1. | | 6.500 | |
| Reversing Rougher, Pass No. 2. | | 4.700 | |
| Reversing Rougher, Pass No. 3. | 85 sec. | 3.200 | |
| Reversing Rougher, Pass No. 4. | | 2.000 | |
| Reversing Rougher, Pass No. 5. | | 1.250 | 2160/2250 F. |
| Transfer time to Finisher | 25 sec. | | |
| Finishing Mills, Pass No. 6. | | 0.610 | Front 2100/2200 F. Back 2000/2100 F. |
| Finishing Mills, Pass No. 7. | | 0.355 | |
| Finishing Mills, Pass No. 8. | | 0.225 | |
| Finishing Mills, Pass No. 9. | 10 sec. | 0.145 | |
| Finishing Mills, Pass No. 10. | | 0.105 | |
| Finishing Mills, Pass No. 11. | | 0.080 | Front 1740/1790 F. Back 1690/1740 F. |
| | Total Elapse Time: 150 sec. | | |
| Coiler | | | |

Because of the physical location of the equipment and the nature of the operation, the metal cools and loses temperature because of radiation heat losses, cooling water from various mill stands, and physical contact with the rolling mill rolls and the transfer table rolls. This temperature loss is not uniform, the ends cool more than areas away from the ends and the time delay (65 seconds) of the front end entering the first finishing stand versus the back or last end to enter results in additional radiation, conduction and convection losses. These variations in temperature between slab locations are very important in that they determine when in the process MnS and other constituents will precipitate from solution. It is obvious to the informed that a non-uniformity of precipitate will result under these conditions. The purpose of the teachings of Littmann and Crede are to put the MnS into solution (time and temperature are defined in both patents) and have enough thermal reserve as a result of the high slab temperatures so that precipitation temperatures are not reached during the rough rolling but only are reached when the metal is in the finishing stands, Nos. 5 and 6, Pass Nos. 10 and 11, where precipitation takes place due to the cooling from the mill rolls and roll cooling water. If slab temperature is lost and precipitation takes place too early, the proper orientation is not produced. The existing hot strip mills use various physical means to conserve process temperature.

1. Heavy drafts or reduction in the reversing rougher to conserve time.
2. Air or steam to blow off excess water and conserve temperature.
3. Shielding devices in the finishing mills to keep mills cooling water off the strip.
4. High speeds in the finishing stands to conserve time.

Even with these measures, the temperature variation between the hottest and coldest part of a given slab entering the first finishing stand can be as high as 200°F. and more commonly is 100°F. Temperature variations between slabs is often as high as 300°F. when measured at the same relative location. These temperature variations are reflected in the finished product when the magnetic properties are measured. The ends of the coil usually have poorer magnetic properties than the center of the coil, and the last end into No. 1 finishing mill is poorer than the first or front end (See Crede et al. U.S. Pat. No. 2,867,557).

It, therefore, seems desirable to find a practice which would allow a much more conservative heating practice to be employed which would be sufficient to get the MnS into solution and a rolling process which would conserve this heat all through the reduction from slab to hot roll band, to control by quenching the precipitation of MnS.

Ainslie and Seybolt, Journal of Iron & Steel, March, 1960, PP. 341–348, published a paper entitled, "Diffusion and Solubility of Sulfur in Iron and Silicon Iron Alloys" which discusses the solubility limits of MnS vs. temperature in a 3¼% Si. Iron. These data indicate for a steel containing 0.06% Mn and 0.020% Sulfur, 2300°F. is the temperature at which these MnS products go into solution; for a steel containing 0.06% Mn and 0.027% Sulfur the temperature for complete MnS solubility is 2400°F. Therefore, both the teachings of Littmann and Crede are unique with regard to both time and temperature to have the MnS go into solution, both teachings use much longer times and higher temperatures than necessary to only obtain solubility of MnS. It, therefore, must be concluded that this high thermal head is required to compensate for thermal losses until the slab reaches the finishing mills to accomplish the precipitation of MnS at the proper point in the process.

I have developed a practice for making oriented hot rolled silicon steel strip which overcomes these problems of prior art practices and makes it possible to produce a strip of more uniform electrical and magnetic properties from one end to the other.

Preferably I use a practice incorporating a planetary form of mill such as the so called Zendzimer mill or the Krupp-Platzer mill. Preferably I form the silicon steel into slabs, heat the slabs to temperature required for solution of the MnS ratio, descale, reduce the slabs in a planetary mill with an exit temperature in the range of 2100°F. to 2200°F. to a thickness in the range 0.060 to 0.10 inch and preferably to about 0.080 inch quench to 1700°F. to precipitate MnS and finish in the usual manner.

I have also found that the product can be markedly improved by substituting a warm rolling cycle at 1500–300°F. and preferably in the range 1200°–600°F. to reduce the strip thickness to the range 0.020 to 0.030 inch and preferably about 0.026 inch rather than a cold or ambient temperature rolling as is commonly used for the finishing roll prior to recrystallize normalizing. As I have previously pointed out, silicon steels are made by a variety of hot mill practices. Following the hot mill, the practices are fairly consistent in all cases and usually comprise the following steps:

| Operation | Process Description |
|---|---|
| A. | Hot Roll to 0.080" +/− .010" |
| B. | Hot Band Normalize, |
| C. | Descale and side trim. |
| D. | Cold roll to 0.026" +/− .003". |
| E. | 1725°F. normalize to recrystallize grain structure. |
| F. | Cold roll to 0.012" +/− .002". |
| G. | 1475°F. normalize to decarburize. |
| H. | MgO Coat. |
| I. | $H_2$ Anneal at 2150°F. +/− 100°F. |
| J. | Scrub, heat flatten, and insulate. |
| K. | Slit, inspect, and ship. |

This process produces magnetic properties which are classified and sold in the trade according to industry standards. It is the desire of all manufacturers to make the lowest watt loss for a given flux density and the highest permeability when measured at 10 H.

I have discovered a new and novel technique to improve the above discussed magnetic properties by modifying Step D so that the temperature at which the reduction in thickness from hot roll gauge (0.080 inch) to first cold rolled gauge (0.026 inch) is 1500°–300°F. and preferably 1200°–600°F. rather than at room temperature. As evidence of this improvement, the following examples showing the average results from 17 different samples are:

Final Magnetic Characteristics of Warm Rolled (0.080" to 0.026") Oriented Silicon Steel

| 0.080" Hot Roll Band Reheat Treatment | Sample No.1 WPP at 15KB | WPP at 16.3KB | WPP at 17KB | MU at 10H |
|---|---|---|---|---|
| None | 0.502 | 0.628 | 0.747 | 1820 |

-continued

Final Magnetic Characteristics of Warm Rolled (0.080" to 0.026") Oriented Silicon Steel

| 0.080" Hot Roll Band Reheat Treatment | Sample No.1 WPP at 15KB | WPP at 16.3KB | WPP at 17KB | MU at 10H |
|---|---|---|---|---|
| 600°F | 0.496 | 0.609 | 0.707 | 1840 |
| 850°F. | 0.476 | 0.594 | 0.687 | 1856 |
| 1000°F | 0.469 | 0.589 | 0.681 | 1860 |
| 1150°F | 0.463 | 0.583 | 0.670 | 1858 |
| 1500°F | 0.464 | 0.578 | 0.668 | 1860 |

Product finished by standard practice after rolling warm to 0.026 inch.

The combination of hot planetary mill for hot rolling oriented silicon steel and warm rolling as described above provides a marked improvement in uniformity of product while providing a greater scope of silicon analysis which may be used. The two practices may be combined by taking the product from the hot mill and instead of coiling the 0.080 inch strip, run it through several successive 4 high mills after cooling to about 1500°F. prior to entry and reducing the gauge to intermediate gauge (0.026 inch) and then cool.

It should be clear to those familiar with oriented silicon steel processing that a process whereby the total reduction to 0.026 inch continuously in the hot mill train results in a more economical process than cold rolling from 0.080 inch to 0.026 inch.

Oriented silicon steels today have a nominal composition as follows: 0.032 inch carbon, 0.080 inch Mn, 0.028 S, 0.007 P, 2.90/3.40 Si, + minor residuals. The patent literature discusses compositions for Si in these steels as being in the range of 2.5 to 4.0% Si. However, in actual practice the Si content is limited to about 3.50% max. because of brittleness developing which creates processing hazards with respect to coil breakage. This brittleness, which is associated with the hot roll thickness, can be overcome by warming the hot roll coil to about 250°F. before beginning the process. After it is reduced to intermediate gauge (0.028 inch) the brittleness is no longer apparent. As the silicon content is increased, it requires higher temperatures to overcome the brittleness. Warm rolling after reduction on the planetary mill, in the manner previously described, would allow these steels to be economically manufactured and a new family of oriented silicon steels of higher Si content (up to 6 percent) could be developed.

In the foregoing general description I have set out certain objects, purposes and advantages of this invention. Other objects, purposes and advantages of this invention will be apparent from a consideration of the following description and the accompanying drawings in which:

FIG. 1 is a schematic flow sheet incorporating the method of my invention; and

FIG. 2 is a top plan view of a mill incorporating the features of my invention.

Referring to the drawings I have illustrated a flow sheet for practicing the various steps of my invention. In FIG. 1 I have illustrated an electric furnace 10 for melting the steel, followed by an oxygen vessel 11 for rapid refinement of the steel. The oxygen vessel may be one of the forms now known in the trade as BOF or Q-BOP. The product of the oxygen vessel is fed to a continuous casting assembly 12 which produces slabs which go to continuous furnace 13. It is of course obvious that any other equivalent means for producing the steel such as open hearth may be used and any other means for producing slabs and introducing them to the furnace 13 might be used. The heated slabs from the continuous furnace 13 are delivered to a planetary mill 14 where the heated slab is quickly reduced to about 0.080 inches in thickness, generally in less than 10 seconds. This means that there is no significant heat loss from front to rear end of the reduced strip. The hot strip leaving the planetary mill is cooled and cleaned in cleaning unit 15 and delivered to warm rolling mill 16 in the form of a 4 high mill in the temperature range 300°F. to 1500°F. where it is reduced to about 0.026 inches in thickness and coiled on coiler 17.

In the preferred practice of this invention I incorporate both the planetary hot rolling step and the warm rolling step as a replacement for cold reduction, however either one of these steps will alone markedly improve the production of oriented silicon steel in an otherwise conventional rolling practice.

While I have illustrated and described certain presently preferred embodiments and practices of my invention in the foregoing specification, it will be obvious that this invention may be otherwise embodied within the scope of the following claims.

I claim:

1. The method of producing oriented silicon steel strip of improved physical properties having a silicon content in the range 2.5 to 4.0 percent comprising the steps of:

a. bringing hot rolled strip having a thickness in the range 0.060 to 0.150 inch following normalizing to a temperature below 1500°F. and above 600°F., b. reducing the strip in thickness to final finish thickness prior to recrystallize normalizing to about 0.020 to 0.030 inch while in said temperature range 600°F. to 1500°F., c. normalizing at about 1725°F. to recrystallize grain strength, and d. cold rolling to a selected thickness without further heating.

2. The method of producing silicon steel strip as claimed in claim 1 wherein the strip is reduced to about 0.026 inch while in the range 600°F. to 1500°F.

3. The method of producing silicon steel strip as claimed in claim 1 wherein hot rolled strip from a hot rolling mill is cooled to a temperature range below 1500° and above 600°F. and while in said temperature range and without intermediate cooling and heating reduced in thickness by rolling to a thickness of about 0.020 to 0.030 inch.

* * * * *

UNITED STATES PATENT OFFICE

CERTIFICATE OF CORRECTION

PATENT NO. : 3,969,162
DATED : July 13, 1976
INVENTOR(S) : ROBERT H. HENKE

It is certified that error appears in the above-identified patent and that said Letters Patent are hereby corrected as shown below:

The name of the Assignee should read "ALLEGHENY LUDLUM INDUSTRIES, INC."

Signed and Sealed this

Fifteenth Day of February 1977

[SEAL]

*Attest:*

RUTH C. MASON
*Attesting Officer*

C. MARSHALL DANN
*Commissioner of Patents and Trademarks*